US008443935B2

(12) United States Patent
Nishikawa et al.

(10) Patent No.: US 8,443,935 B2
(45) Date of Patent: May 21, 2013

(54) SOUND ABSORBING BODY

(76) Inventors: Yukihiro Nishikawa, Nara (JP); Yoshiko Nishikawa, Nara (JP)

( * ) Notice: Subject to any disclaimer, the term of this patent is extended or adjusted under 35 U.S.C. 154(b) by 0 days.

(21) Appl. No.: 13/390,351

(22) PCT Filed: Aug. 10, 2010

(86) PCT No.: PCT/JP2010/063525

§ 371 (c)(1),
(2), (4) Date: Feb. 14, 2012

(87) PCT Pub. No.: WO2011/021533

PCT Pub. Date: Feb. 24, 2011

(65) Prior Publication Data

US 2012/0145479 A1 Jun. 14, 2012

(30) Foreign Application Priority Data

Aug. 19, 2009 (JP) ..... 2009-189931

(51) Int. Cl.
*E04B 1/82* (2006.01)

(52) U.S. Cl.
USPC ..... 181/290

(58) Field of Classification Search
USPC ..... 181/290, 284
See application file for complete search history.

(56) References Cited

U.S. PATENT DOCUMENTS

| | | | | |
|---|---|---|---|---|
| 4,340,129 | A * | 7/1982 | Salyers | 181/200 |
| 6,951,264 | B2 * | 10/2005 | Byma et al. | 181/286 |
| 7,182,172 | B2 * | 2/2007 | Albin, Jr. | 181/290 |
| 7,987,645 | B2 * | 8/2011 | Tinianov | 52/403.1 |
| 2005/0098379 | A1 | 5/2005 | Sato et al. | |
| 2005/0241877 | A1 * | 11/2005 | Czerny et al. | 181/293 |
| 2005/0263346 | A1 * | 12/2005 | Nishimura | 181/290 |
| 2007/0012509 | A1 * | 1/2007 | Shimada et al. | 181/256 |
| 2008/0067001 | A1 * | 3/2008 | Sviridenko et al. | 181/286 |
| 2008/0193738 | A1 * | 8/2008 | Hensley et al. | 428/308.4 |

FOREIGN PATENT DOCUMENTS

| | | | |
|---|---|---|---|
| JP | 55-18686 | A | 2/1980 |
| JP | 8-87278 | A | 4/1996 |
| JP | 2004-25918 | A | 1/2004 |
| JP | 2006-30397 | A | 2/2006 |
| JP | 2007-34254 | A | 2/2007 |
| JP | 2011-2523 | A | 1/2011 |

* cited by examiner

*Primary Examiner* — Forrest M Phillips
(74) *Attorney, Agent, or Firm* — McDermott Will & Emery LLP

(57) ABSTRACT

A sound-absorbing body having sound-absorbing characteristics suitable for in-home and car audio systems, wherein the indoor echo of sound wave output from a speaker or echo in a speaker enclosure should be reduced. Namely, showing flat sound-absorbing properties while maintaining a high sound-absorbing ratio in the medium tone range, having a simple structure, is easily installed, water-resistant and is decorative. Specifically, a sound-absorbing body having a plurality of porous members provided with air holes therein and a structure composed by three or more layers formed by bonding the individual porous members via an adhesive layer having a preset thickness, wherein one side of said structure is located in the side of a sound source and the other side of said structure has a peak-and-valley pattern that is formed by alternately positioning said porous members and air layers to thereby flatten and improve the sound-absorbing ratio in the medium tone range.

20 Claims, 2 Drawing Sheets

SOUND ABSORBING BODY

CROSS REFERENCE TO PRIOR APPLICATIONS

This application is a U.S. National Phase application under 35 U.S.C. §371 of International Application No. PCT/JP2010/063525, filed on Aug. 10, 2010 and claims benefit of priority to Japanese Patent Application No. 2009-189931, filed on Aug. 19, 2009. The International Application was published in Japanese on Feb. 24, 2011 as WO 2011/021533 A1 under PCT Article 21(2). All of these applications are herein incorporated by reference.

FIELD OF TECHNOLOGY

The present invention relates to a sound absorbing body wherein porous materials are layered,

BACKGROUND

Conventionally, sound absorbing bodies have been used to adjust the reverberation within rooms such as for home audio and car audio, and the reverberation within speaker enclosures.

There are basically two methods by which sound absorbing bodies absorb sound, a method that uses the viscous resistance of air and a method that uses attenuation within a material.

As one sound absorbing method that uses the viscous resistance of air, there is a method that uses a porous material, such as soft polyurethane foam, where sound is absorbed within the minute airspace through a portion of the vibrational energy being converted into thermal energy, when a sound wave enters into the porous material, due to the viscous resistance of the air, and due to friction with the surrounding.

As a method that uses the other, that is, internal attenuation, there is a method that uses a membrane or a plate, where sound is absorbed through attenuation within the material through the acoustic energy causing the membrane or plate to vibrate.

However, in these sound absorbing methods, the absorption is not necessarily uniform for sound waves across the audible frequency band, where the porous material is superior in terms of the sound absorption characteristics in the high-frequency range and vibrating the membrane or plate exhibits a peak in the sound absorption characteristics at the resonant frequency thereof.

Moreover, with the porous material it is known that the sound absorption characteristics in the low-frequency band can be improved through a method of increasing the thickness, where effective sound absorption characteristics are present if the thickness is at least ¼ the wavelength of the sound wave, but at a frequency of 100 Hz the thickness would be about 85 cm, and thus the locations wherein sound absorbing bodies with such thicknesses can be installed are inherently limited.

In order to solve such conventional problems, an overall improvement in the sound absorption characteristics has been achieved in the middle and low frequency band with a practical thickness through the formation of a film on the porous material in, for example, Japanese Unexamined Patent Application Publication 2007-34254.

However, the conventional sound absorbing body does not take into consideration acoustic reverberation in uses such as home audio and car audio, and usually sound absorption characteristics that are biased towards the high-frequency band or the low-frequency band, or towards a specific frequency, are seen.

When these sound absorbing bodies, for example, a sound absorbing body having sound absorption characteristics that are biased towards the high-frequency band, are used, the result will be the audio sounding muddy, and when a sound absorbing body having characteristics that are biased towards the low-frequency band are used, the result will be that the sound lacks richness, and sounds barren.

While various combinations of these methods are used in order to solve these problems, determining the optimal combination and installation location requires a high level of knowledge and installation skill, and thus there has been no choice but to rely on an expert in acoustical design.

Moreover, when used in combination, the respective sound absorbing bodies have been arrayed together for use, but in some cases there have been problems with variability in the acoustics depending on the listening point, and cases wherein installation has not been possible due to space problems.

Moreover, for household use there is the need for extreme thinness, given the space problem, for ease in cutting and processing from the perspective of these in installation, simplicity in disposal after cutting, ease in mounting to wall surfaces, and the like, and further, when installed in a location that is likely to be seen, such as within a room, there is also the need for decoration.

The present invention is the result of focus on the conventional problem areas set forth above, and the object of the present invention is to provide a sound absorbing, body that has sound absorbing characteristics that are desirable for the intended use, that is, in suppressing reverberation, within a room, of the sound waves outputted from a speaker or suppressing reverberation within a speaker enclosure, and in maintaining a high sound absorption rate in the mid-frequency band, with flat characteristics, and, in order to be used with ease in a typical home, has a simple structure, can be installed easily, and can be decorated.

SUMMARY

The sound absorbing body according to examples of the present invention is a structured body of three or more layers wherein a plurality of porous materials having pores, wherein individual porous materials are bonded by an adhesive layer having a specific thickness, where one side of the structured body is provided on the sound source side, and the other side of the structured body has indentations and protrusions wherein the porous materials and air layers are disposed alternatingly, and is provided on a partitioning watt between the sound wave incident direction and the opposite side, to flatten the mid-frequency range sound absorption rates.

The examples of the present invention, given the configuration set forth above, is well-suited for use for home audio, car audio, and the like because of defect-tree, essentially uniform sound-absorption effects in the mid-frequency range, which is the key portion in music, when compared to that which is conventional, given the distinctive features of this structure.

Moreover, in examples of the present invention, a water-repellent treatment is performed on the porous material, where water is shed through a water shedding path that is produced by the shape of the sound absorbing body in the present invention. Moreover, if the water-repellent treatment is performed so far as to reach into the interior of the porous material, then there is no limitation on the location wherein it can be cut, given the water repulsion at any place within the sound absorbing body. Because of this, when used in car audio, or the like, it can be formed into a variety of shapes and sizes, depending on the model of car, and will be well-suited for use in cases wherein the sound absorbing body is installed within a door interior wherein rain and water may incur.

Additionally, in the present invention, preferably the porous material is noncombustible, making it suitable for use in situations where non-combustibility is required as well.

Moreover, in the present invention, preferably the porous material is a soft polyurethane foam for which the sound absorption rate has been increased through a hot compression treatment of Japanese Patent Application 2009-143759 ("JP '759"), which is a previous application by the present inventor.

Additionally, the porous material can use a soft polyurethane foam wherein the hot compression treatment has been performed using a die wherein a decoration has been made to the surface of the die for performing the hot compression molding according to JP '759, to apply decorations, to make it well-suited for use even when there are many opportunities to be seen directly, such as within a room.

Moreover, in examples of the present invention, preferably the porous material uses a soft polyurethane foam to which a flocking process has been performed, to make it well-suited for use even when there are many opportunities to be seen directly, such as within a room.

Moreover, in the present invention preferably the structural body is wrapped in a fabric, to make it well-suited for use even when there are many opportunities to be seen directly, such as within a room.

In contrast to the sound absorption characteristics that are biased to a specific frequency band, with the structure of a porous material and a film adhered to the side on which the sound waves are incident, in the examples of the present invention the acoustic characteristics are improved and flattened through the sound absorbing body that is a structured body of three or more layers wherein a plurality of porous materials having pores, wherein individual porous materials are bonded by an adhesive layer having a specific thickness, where one side of the structured body is provided on the sound source side, and the other side of the structured body has a corrugated shape wherein the porous materials and air layers are disposed alternatingly.

Moreover, by having the porous material on the partitioning wall side have a corrugated shape makes it possible to control the sound absorption characteristics, without limiting the material, through adjusting the airspace/porous material ratio and the shape thereof.

Moreover, because the structure is of porous material and the adhesive layer alone, installation is easy, and if a water-repellent porous material is used, the corrugated shape of the porous material layer on the partitioning wall side makes the sound absorbing body into a water-resistant sound absorbing body that also has a water-shedding function.

DETAILED DESCRIPTION

Figure 1:
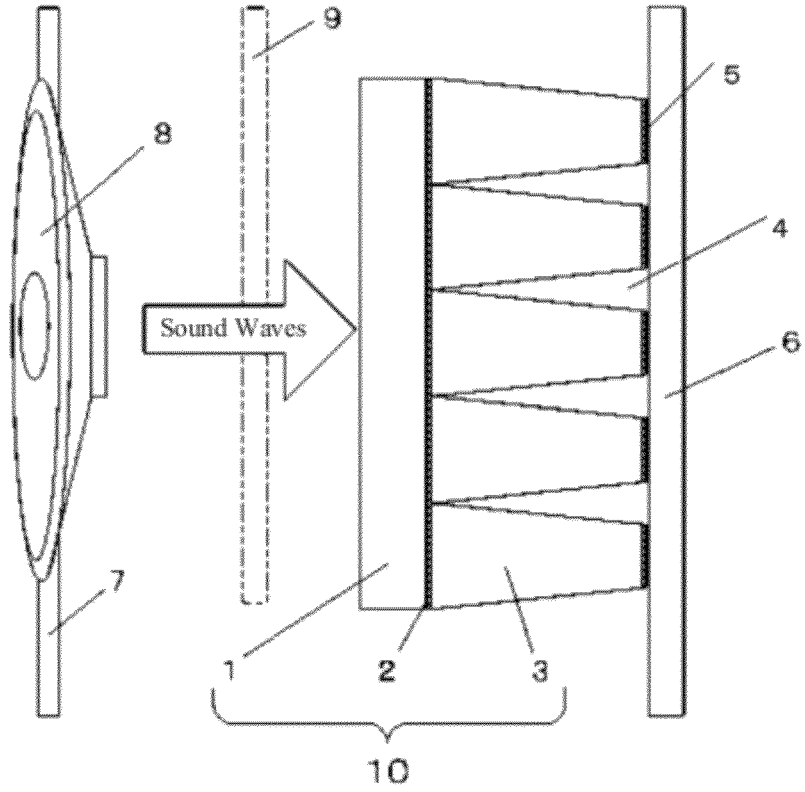
FIG. 1 is a schematic plan view diagram of the sound absorbing body according to an example, when viewed from above.
Figure 2:
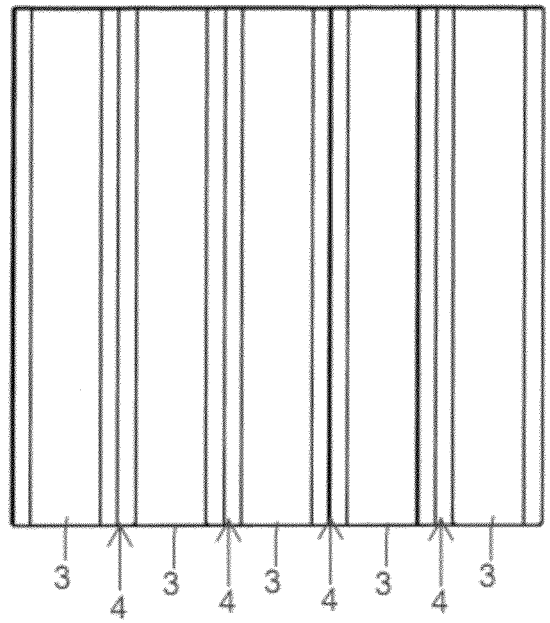
FIG. 2 is a schematic back view diagram of the sound absorbing body according to another example.

FIG. 1 illustrates the structure of an example of embodiment of a sound absorbing body according to the present invention. FIG. 1 is a schematic plan view diagram of an example wherein an automobile door interior is viewed from above, and FIG. 2 is a schematic back view diagram of an example of the product.

Baffles 1, 3 can be porous materials having pores in the interior thereof, where, in the present example, each is made from a soft polyurethane foam. Adhesive layer 2 is used for bonding baffles 1, 3 these together, and, in the present example, is a double-sided adhesive tape 2 that uses a non-woven fabric as the base material thereof.

Baffles 1, 3 and adhesive layer 2 in FIG. 1 are the structured body 10 in the present invention. Note that in the below, when indicating the layered relationship, the porous material 1 shall be referred to as the first layer, the adhesive layer 2 shall be referred to as the second layer, and the porous material 3 shall be referred to as the third layer.

Specific examples according to the present invention are set forth below.

While an example in car audio is set forth below as a specific method of use for the sound absorbing body according to the present invention; the present invention is not limited to the example set forth below.

In car audio, reduction of reverberation is achieved through the provision of a sound absorbing body within a speaker enclosure that is the door (partitioning walls 6 and 7) wherein the speaker is embedded.

Additionally, the space within the door is limited, where usually, when the window glass is down between the partitioning wall 6 and the partitioning wall 7, the spacing from the partitioning wall 6 is no more than 80 mm, and, in order to avoid interferences, the thickness of the sound absorbing body in the present example of embodiment is between 10 and 70 mm, and, preferably, between 30 and 60 mm.

Moreover, because rain water incurs into the interior of the door, water resistance is required, and thus the sound absorbing body must be a water repelling-type water resistant sound absorbing body.

First a soft polyurethane foam 3, that is a trapezoid with a top base of 10 mm, a bottom base of 16 mm, and a height of 30 mm, is cut into rectangles 300 mm long, and a soft polyurethane foam 1, with a length of 300 mm, a width of 300 mm, and a thickness of 10 mm, are submerged in a liquid solution of a water-repellent agent, and then dried.

After thorough drying, a double-sided adhesive tape 2 is applied over the entirety of the back face of the soft polyurethane foam 1, and soft polyurethane foams 3 are adhered side-to-side, without gaps, to the double-sided tape 2, with the bottom base 16-mm side adhered, to produce a structured body according to the present invention with a length of 300 mm, a width of 300 mm, and a thickness of 40 mm.

Moreover, in a similar example, double-sided tapes 5 with widths of 10 mm are adhered to the 10 mm parts of the soft polyurethane foams 3 on the partitioning wall side of the sound absorbing body. This is in order to adhere and install the sound absorbing body according to the present invention onto the partitioning wall 6, that is, onto the inside of the outer panel of the door.

Doing so reduces the leakage of reverberation into the passenger compartment by attenuating the reverberation within the door, through the effect of the sound absorbing body of the present invention on the sound waves outputted from the back face of the speaker 8 that is the sound source that is installed on the partitioning wall 7 that is the interior panel of the door.

Next the example of the present invention was installed in the door of an actual automobile and sent once through an automatic car wash in a state wherein the window was closed, and the increases in mass of the sound absorbing bodies according to the present example due to moisture incursion were compared for the water-resistant moisture absorbing body according to the present example and a moisture absorbing body of the same shape to which the water-repellent treatment was not performed.

In contrast to the increase in mass of the sound absorbing body according to the present example, to which the water-repellent treatment had been performed, being 0.2 g, the figure was 62.1 g for the un-treated case.

From these results, the sound absorbing body according to the present example can be considered to be exhibiting fully the effects of the water-repellent treatment, enabling use even as a sound absorbing body requiring water resistance, such as for car audio.

Moreover, while with the conventional water-repellent sound absorbing body there is no place for the water to go after being repelled, where it can be anticipated to pool on the top portion of the sound absorbing body, in the sound absorbing body according to the present example the airspace in the third layer 3 operates effectively as a water shedding path for the water that is repelled.

Moreover, while conceivably water may incur into the interior of the porous material due to falling rain, and the like, over an extended period of time, even if water were to incur into the interior of the porous material, the distance between the deepest portion of the porous material to the surface thereof is uniformly short, regardless of the location, and thus one can anticipate also effects such as a greatly reduced drying time.

Figure 3:
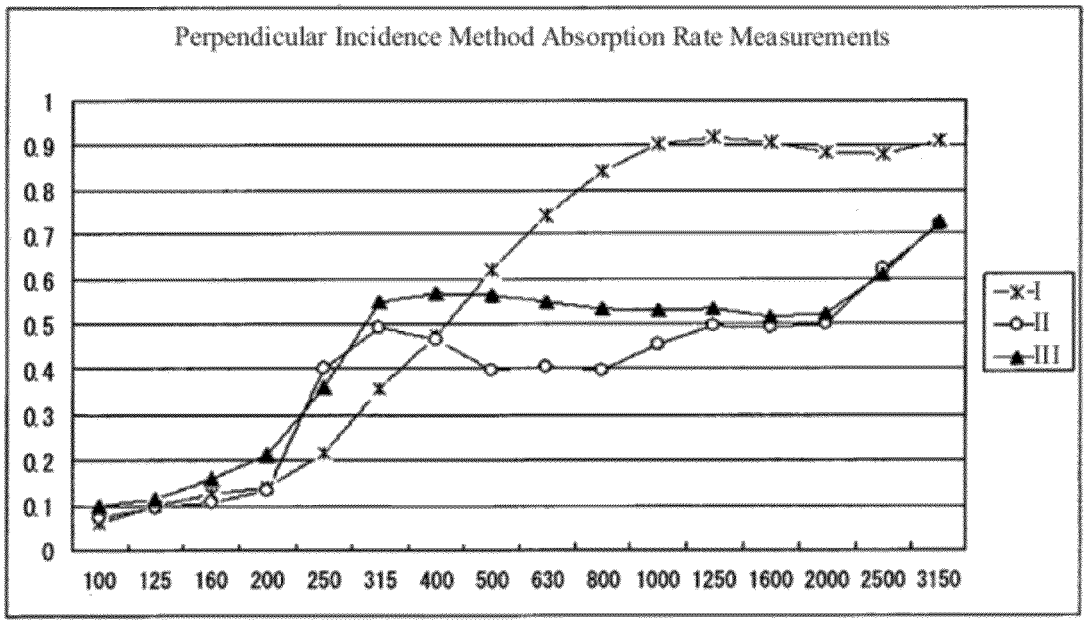
FIG. 3 is a graph illustrating the sound absorbing rates at various frequencies for a sound absorbing body according to examples of the present invention.

The measurement data for the sound absorption rate using the perpendicular incidence method is shown next in FIG. 3. Reference I is for soft polyurethane foam alone, reference III is for the sound absorbing body according to the present example having a corrugated shape on the partitioning wall side, and reference II is for a sound absorbing body having the same layered structure as in the sound absorbing body of the present example, but not having the corrugated shape on the partitioning wall side. Note that the thickness for each of the sound absorbing bodies is 40 mm. The vertical axis of the graph shows the sound absorption rate, and the horizontal axis shows the frequency (Hz).

That which is clear from these data is that the porous material that is a single material (I in the graph), which has the sound absorbing property that rises on the right is caused to be essentially fiat in the mid-frequency range through the use of the layered structure that is the same as in the sound absorbing body according to the present invention (II in the graph), and that the use of the shape of the sound absorbing body according to the present invention (III in the graph) further improves the flatness of the sound absorption rates in the mid-frequency range.

Note that while the reason for the improved flatness of the sound absorption rates in the mid-frequency range are not completely clear at this time, the following observations can be made.

The reason is thought to be that, with the first layer (the porous material 1), the second layer (the adhesive layer 2), and the third layer (the porous material 3), in the order in which the sound waves outputted from the speaker are incident in the sound absorbing body according to the present example, first the sound in the mid-frequency through a high-frequency band is absorbed in the first layer, following which sound absorption through membrane vibration is performed on the mid-frequency through low-frequency band component that has passed through the first layer 1, using the attenuation within the membrane of the second layer 2, and, in the third layer 3, the alternating arrangement of the porous material and the air layers 4, which is the most critical point in the present invention, causes the physical strength of the third layer to be reduced so that, when the first layer and second layer, which are layered together, is treated as a compound monolithic membrane, this third layer fulfills the role of a spring that provides gentle support thereto, and, in addition, by the area with which is bonded to the partitioning wall being lines or being points, the sound absorbing body itself, in the present invention, can be vibrated to further increase the sound absorption ratio in the mid-frequency band.

Note that while in the present example the porous materials 1 and 3 used soft polyurethane foam, they may, of course, be other porous materials instead. Moreover, the porous materials 1 and 3 may either be made of identical materials or different materials. Moreover, preferably the porous material, with a thickness of 30 mm, has a value of at least 0.2 for the perpendicular incidence-method sound absorption rate NRC (noise reduction coefficient, a value wherein the calculated mean of sound absorption rates at the four frequencies of 250 Hz, 500 Hz, 1000 Hz, and 2000 Hz is rounded to 0 or 5 in the second digit after the decimal).

Additionally, while a double-sided adhesive tape that used a non-woven fabric as the base material was used as the adhesive layer 2 in the present example, instead a double-sided adhesive tape that uses a film as a base material, or a double-sided adhesive tape that has no base material, may be used instead. Moreover, for a double-sided adhesive tape that has a base material, the three layers comprising the adhesive agent layer, the base material, and the adhesive agent layer may be considered to be a single layer. Moreover, while the structure may be one wherein there is only the adhesive agent fur bonding the porous materials, preferably this adhesive layer has a breathability of no more than 50 $cc/cm^2/sec$, where the breathability is measured based on JIS L-1096.

Note that preferably the soft polyurethane foams 1 and 3 in the present example use hot compression-molded soft polyurethane foams wherein the sound absorption rate has been improved, according to JP '759.

Note that preferably the soft polyurethane foam 1 in the present example uses a hot compression-molded soft polyurethane foam, to which a decoration process has been performed, wherein the sound absorption rate has been improved, according to JP '759.

Note that the soft polyurethane foams 1 and 2 in the present example preferably use soft polyurethane foams to which a flocking process has been performed.

Note that preferably the soft polyurethane foams 1 and 3 in the present example use a non-combustible porous material.

Note that if installed in a location that can be seen, such as within a room, preferably the structured body in the present example is wrapped in a fabric.

Note that the measurement of the sound absorption rate used a measurement method according to the JIS Standard, JIS A 1405-2, "Sound Absorption Rate and Impedance Measurements in Acoustic Tubes—Part 2: Transfer Function Method."

Note that while in the present example of embodiment use within a speaker enclosure in car audio was envisioned when setting the thickness and the dimensions, there is no limitation thereto in other cases, such as use within an automobile cabin, use in an enclosure for home audio, used in a room, and the like.

While the present form of embodiment has the benefits set forth above due to the structure set forth above, various appropriate design changes are possible within the scope of the spirit and intent of the present invention.

That is, the present invention is not limited to the examples set forth above, but rather the thicknesses and shapes of the porous materials in the first and third layers, and the thickness and method of adhesion for structuring the second layer, may use that which is appropriate. Moreover, insofar as it is within the spirit and intent of the present invention, there may be any ratio for the air layer and the porous material in the third layer, and the shape thereof may be round, elliptical, undulating, triangular, squamous, hexagonal, or any other shape. Moreover, the ratio and shape may be changed as appropriate to achieve modifications in the sound absorbing characteristics.

The invention claimed is:

1. A sound-absorbing body for audio, comprising:

a structured body comprising at least three layers including a first porous layer, a second porous layer and an adhesive layer bonding the first porous layer and the second porous layer, the first and second porous layers having air holes internal thereto, the adhesive layer performing sound absorption through film vibration, wherein:

the first porous layer is provided on a sound source side, the second porous layer is formed in a corrugated shape such that porous materials and air layers are disposed alternately and each of the porous material has a volume that increases toward a sound source, and at least the first porous layer includes a foamed porous material.

2. The sound-absorbing body for audio as set forth in claim 1, wherein the air layers of the corrugated shape have a recessed shape with a width of at least 3 mm and a depth of at least 3 mm.

3. The sound-absorbing body for audio as set forth in claim 1, wherein:

the structured body is provided in an interior of a space that has the sound source and that is structured by partitioning walls, so that the first porous layer is provided on the sound source side and the second porous layer is provided on a portioning wall side.

4. The sound-absorbing body for audio as set forth in claim 1, wherein the first and second porous layers are made hydrophobic by being submerged in a liquid solution of a water-repellent agent and then being dried so that an interior of the first and second porous material is water-repellent treated.

5. The sound-absorbing body for audio as set forth in claim 1, wherein a corrugated surface of second porous layer opposite from the sound source is an attaching surface.

6. The sound-absorbing body for audio as set forth in claim 1, wherein the foamed porous material includes polyurethane.

7. The sound-absorbing body for audio as set forth in claim 1, wherein the adhesive layer has a breathability equal to or less than 50 $cm^3/cm^2/s$.

8. The sound-absorbing body for audio as set forth in claim 1, wherein the foamed porous material is a material having a noise reduction coefficient (NRC) of 0.2 or more, at a thickness of 30 mm, for a perpendicular incidence-method sound absorption rate where the NCR is a calculated mean of sound absorption rate at four frequencies of 250 Hz, 500 Hz, 1000 Hz and 2000 Hz with being rounded to 0 or 5 in the second digit after the decimal.

9. A sound-absorbing body for audio, comprising:

a structured body comprising at least three layers including a first porous layer, a second porous layer and an adhesive layer bonding the first porous layer and the second porous layer, the first and second porous layers having air holes internal thereto, the adhesive layer performing sound absorption through film vibration, wherein:

the first porous layer is provided on a sound source side, the second porous layer is formed in a corrugated shape such that porous materials and air layers are disposed alternately and each of the porous material has a volume that increase toward a sound source, and the adhesive layer has a breathability of no more than 50 $cc/cm^2/sec$.

10. The sound-absorbing body for audio as set forth in claim 9, wherein the air layers of the corrugated shape have a recessed shape with a width of at least 3 mm and a depth of at least 3 mm.

11. The sound-absorbing body for audio as set forth in claim 9, wherein the structured body is provided in an interior of a space that has the sound source and that is structured by partitioning walls, so that the first porous layer is provided on the sound source side and the second porous layer is provided on a portioning wall side.

12. The sound-absorbing body for audio as set forth in claim 9, wherein the first and second porous layers are made hydrophobic by being submerged in a liquid solution of a water-repellent agent and then being dried so that an interior of the first and second porous material is water-repellent treated.

13. The sound-absorbing body for audio as set forth in claim 9, wherein:

the adhesive layer includes a base material and adhesive agent layer formed on both faces of the base material, and the base material includes non-woven fabric.

14. The sound-absorbing body for audio as set forth in claim 9, wherein at least the first porous layer includes a foamed porous material.

15. The sound-absorbing body for audio as set forth in claim 9, wherein the first and second porous layers are made of a same material.

16. A sound-absorbing body for audio, comprising:

a structured body comprising at least three layers including a first porous layer, a second porous layer and an adhesive layer bonding the first porous layer and the second porous layer, the first and second porous layers having air holes internal thereto, the adhesive layer performing sound absorption through film vibration, wherein:

the first porous layer is provided on a sound source side, the second porous layer is formed in a corrugated shape such that porous materials and air layers are disposed alternately and each of the porous material has a volume that increase toward a sound source, the second porous layer includes a plurality of porous layer blocks, and each of the plurality of porous layer blocks has a volume that increases toward the sound source and is attached to the first porous layer by the adhesive layer.

17. The sound-absorbing body for audio as set forth in claim 16, wherein the structured body is provided in an interior of a space that has the sound source and that is structured by partitioning walls, so that the first porous layer is provided on the sound source side and the second porous layer is provided on a portioning wall side.

18. The sound-absorbing body for audio as set forth in claim 16, wherein the first and second porous layers are made hydrophobic by being submerged in a liquid solution of a water-repellent agent and then being dried so that an interior of the first and second porous material is water-repellent treated.

19. The sound-absorbing body for audio as set forth in claim 16, wherein a corrugated surface of second porous layer opposite from the sound source is an attaching surface.

20. The sound-absorbing body for audio as set forth in claim 16, wherein at least the first porous layer includes a foamed porous material.

* * * * *